US008347531B2

(12) United States Patent
Krebs et al.

(10) Patent No.: US 8,347,531 B2
(45) Date of Patent: Jan. 8, 2013

(54) STEAM IRONING APPLIANCE COMPRISING A WATER CONTAINER DIRECTLY CONNECTED TO A BOILING COMPARTMENT

(75) Inventors: Martin Krebs, Obernburg (DE); Reinhard Ahlers, Offenbach (DE); Stefan Panten, Frankfurt (DE)

(73) Assignee: Rowenta Werke GmbH, Offenbach (DE)

( * ) Notice: Subject to any disclaimer, the term of this patent is extended or adjusted under 35 U.S.C. 154(b) by 604 days.

(21) Appl. No.: 12/526,906

(22) PCT Filed: Feb. 4, 2008

(86) PCT No.: PCT/IB2008/000322

§ 371 (c)(1),
(2), (4) Date: Oct. 14, 2009

(87) PCT Pub. No.: WO2008/099266

PCT Pub. Date: Aug. 21, 2008

(65) Prior Publication Data

US 2010/0043257 A1 Feb. 25, 2010

(30) Foreign Application Priority Data

Feb. 12, 2007 (FR) ..... 07 00984

(51) Int. Cl.
*D06F 75/14* (2006.01)
*D06F 75/10* (2006.01)

(52) U.S. Cl. ..... 38/77.8

(58) Field of Classification Search ..... 38/77.8–77.83, 38/69, 14; 15/321; 68/222
See application file for complete search history.

(56) References Cited

U.S. PATENT DOCUMENTS

| | | | | |
|---|---|---|---|---|
| 1,991,381 | A | 2/1935 | Dickman | |
| 2,160,421 | A | 5/1939 | Sebo | |
| 2,336,807 | A | 12/1943 | Schwartz | |
| 2,419,705 | A * | 4/1947 | Busch et al. | 38/77.8 |
| 2,620,576 | A * | 12/1952 | Stevenson et al. | 38/77.3 |
| 3,407,522 | A * | 10/1968 | Jepson et al. | 38/77.5 |
| 3,581,529 | A | 6/1971 | Mitchell et al. | |
| 3,690,024 | A | 9/1972 | Osrow | |
| 3,742,629 | A | 7/1973 | Plasko | |
| 5,063,697 | A * | 11/1991 | Valente et al. | 38/75 |
| 5,307,573 | A * | 5/1994 | Watkins | 38/77.8 |
| 6,446,370 | B1 * | 9/2002 | Ostermaier | 38/77.6 |
| 7,451,559 | B2 * | 11/2008 | Chen et al. | 38/77.3 |
| 2002/0020086 | A1 | 2/2002 | Ostermaier | |
| 2003/0000116 | A1 | 1/2003 | Yao | |

* cited by examiner

*Primary Examiner* — Ismael Izaguirre
(74) *Attorney, Agent, or Firm* — Browdy and Neimark, PLLC

(57) ABSTRACT

Steam wrinkle-removing appliance comprising a water tank (110) in direct communication with a steam-producing boiling chamber (60), said boiling chamber (60) comprising a heating unit (4) and a steam outlet (62) through which the steam can freely flow toward a wrinkle-removing element such as a steam brush, characterized in that the boiling chamber (60) is supplied with water from the tank (110) by means of several supply lines (70) with a small flow cross-section of less than 15 $mm^2$, said supply lines extending lengthwise between an end (70A) opening into the tank (110) and an end (70B) opening into the boiling chamber (60) so as to generate head losses that limit the backflow of hot water or steam toward the tank (110).

18 Claims, 3 Drawing Sheets

STEAM IRONING APPLIANCE COMPRISING A WATER CONTAINER DIRECTLY CONNECTED TO A BOILING COMPARTMENT

The present invention relates to a steam wrinkle-removing appliance comprising a water tank in direct communication with a steam-producing boiling chamber, and more particularly relates to a wrinkle-removing appliance wherein the boiling chamber includes heating means and an outlet through which the steam can flow freely toward a steaming element.

There is a steam wrinkle-removing appliance, known from the document U.S. Pat. No. 3,581,529, comprising a tank that includes a heating element that makes it possible to bring the water in the tank to a boil, the tank comprising, in its upper part, a steam outlet in direct communication with a hose connected to a steam brush.

Such an appliance, however, has the disadvantage of requiring too long a heating time to obtain steam when the appliance is turned on, since the heating element has to bring the entire volume of water contained in the tank to a boil before steam is obtained.

It is known from the documents U.S. Pat. No. 3,690,024 and U.S. Pat. No. 3,742,629 to eliminate this drawback by placing the heating element in a substantially closed compartment defining a boiling chamber of limited volume which is gradually supplied with water by the tank, the compartment comprising, in its upper part, an outlet that allows the steam to freely flow into the tank, then out through a tube provided in the upper part of the tank.

The presence of such a substantially closed compartment around the heating element has the advantage of reducing the volume of water to be brought to a boil to just the volume of water present in the boiling chamber. Such a solution makes it possible to considerably reduce the time required to obtain steam when the appliance is turned on.

However, in such quick-heating appliances, the pressure generated by the heating of the water inside the boiling chamber can cause a backflow of water from the boiling chamber to the tank and generate untimely interruptions in the production of steam due to a temporary lack of water in the boiling chamber. These interruptions in the production of steam can also be caused by the emission of steam bubbles through the supply inlets of the boiling chamber.

Thus, one object of the present invention is to propose a wrinkle-removing appliance that eliminates these drawbacks.

To this end, an object of the invention is a steam wrinkle-removing appliance comprising a water tank in direct communication with a steam-producing boiling chamber, the boiling chamber comprising a heating unit and a steam outlet through which the steam can freely flow toward a wrinkle-removing element such as a steam brush, characterized in that the boiling chamber is supplied with water from the tank by means of several supply lines with a small flow cross-section of less than 15 $mm^2$, the supply lines extending lengthwise between an end that opens into the tank and an end that opens into the boiling chamber so as to generate head losses that limit the backflow of hot water or steam toward the tank.

What is meant by a water tank in direct communication with a boiling chamber is that the boiling chamber is connected to the tank by the supply lines, without the interposition of a valve.

What is meant by a supply line extending lengthwise is a line having a length equal to at least three times the width of the flow cross-section.

According to another feature of the invention, the appliance includes at least four supply lines disposed in parallel.

According to another feature of the invention, the supply lines extend along a length of more than 30 mm.

According to another feature of the invention, the end of the supply lines that opens into the tank is at a lower level than the end that opens into the boiling chamber.

According to yet another feature of the invention, the supply lines have a part extending horizontally in the bottom of the tank and a bent part opening into a recess in the bottom of the tank.

According to another feature of the invention, the supply lines are defined by an insert in the bottom of the tank.

According to yet another feature of the invention, a wall extends into the boiling chamber in front of and in proximity to the end of the supply lines so as to form a barrier that limits the backflow of water or steam toward the tank.

According to another feature of the invention, the heating unit includes a heating resistor extending horizontally in the bottom of the boiling chamber.

According to another feature of the invention, the heating resistor is in a thermally conductive relationship with a crown extending vertically inside the boiling chamber.

According to another feature of the invention, the boiling chamber has a volume that is limited relative to the volume of the tank.

According to another feature of the invention, the boiling chamber is incorporated into the tank.

According to another feature of the invention, the steam outlet of the boiling chamber is in communication with a hose connected to the steaming element so that the steam produced by the boiling chamber is not diffused into the tank.

According to another feature of the invention, the hose is made of EPDM material.

The objects, aspects and advantages of the present invention will be more clearly understood from the description given below of a particular embodiment of the invention presented as a non-limiting example, in reference to the attached drawings, in which.

Only the elements required to understand the invention have been illustrated. To facilitate the reading of the drawings, the same elements have the same references from one figure to another.

Figure 1:
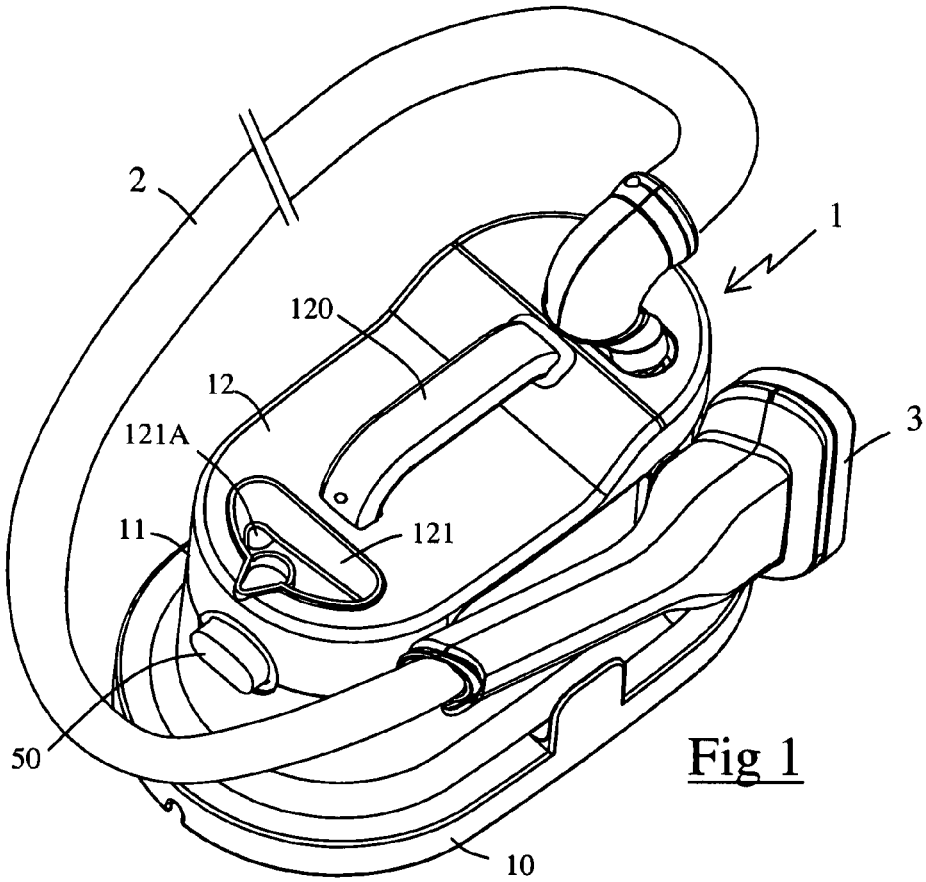
FIG. 1 is a perspective view of a wrinkle-removing appliance according to a particular embodiment of the invention.

FIG. 1 shows a steam wrinkle-removing appliance comprising a steam-generating base 1, connected by a hose 2 to a steam brush 3.

Figure 3:
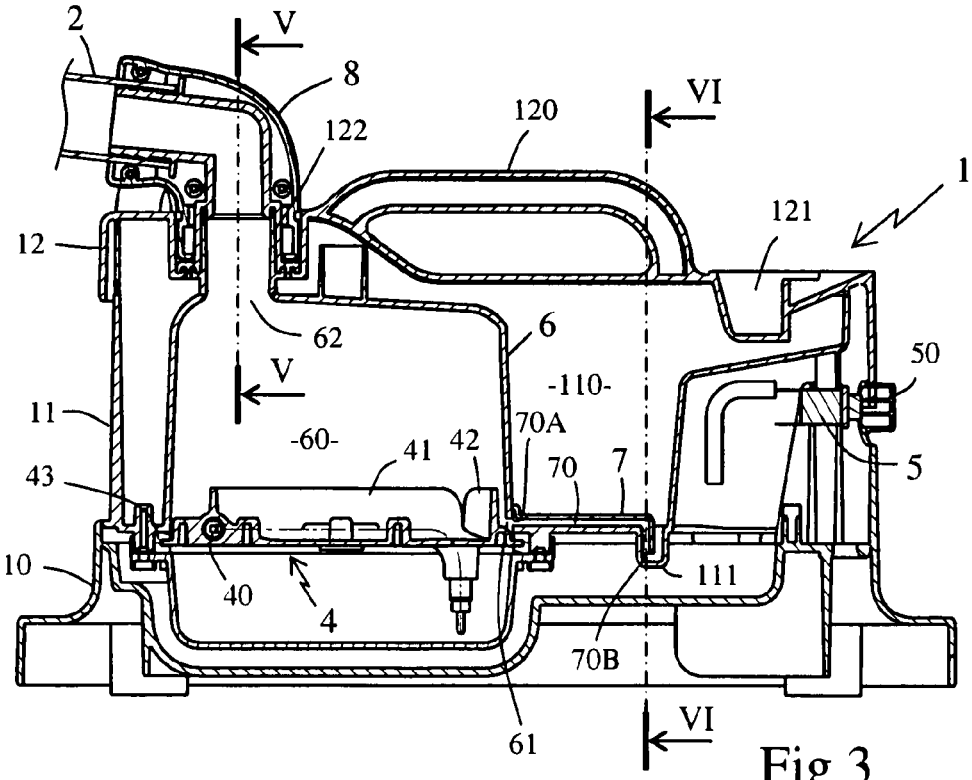
FIG. 3 is a longitudinal sectional view of the appliance of FIG. 1.
Figure 2:
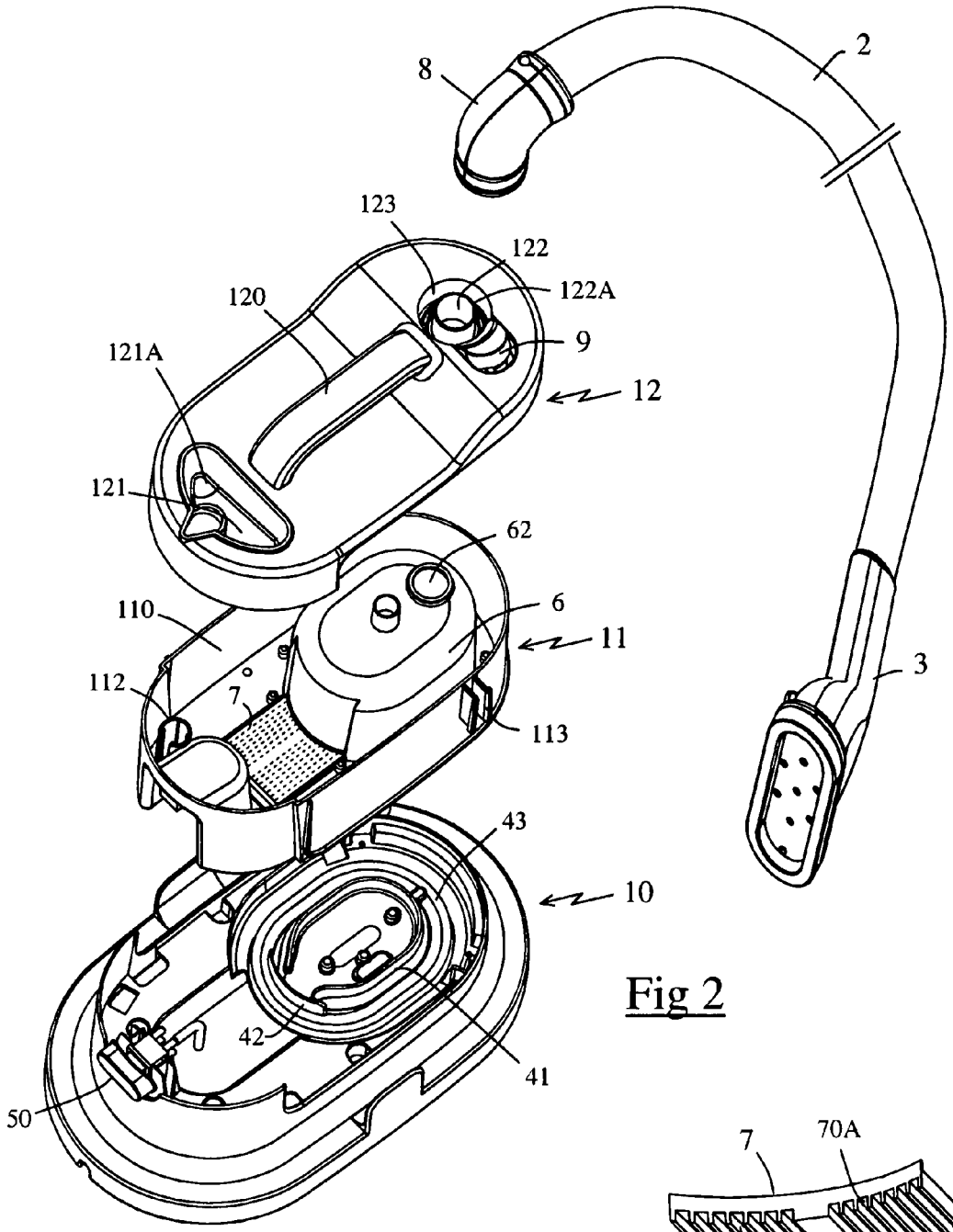
FIG. 2 is an exploded perspective view of the appliance of FIG. 1.

In accordance with FIGS. 2 and 3, the base 1 is constituted by the assembly of a pedestal 10, a body 11 and a cover 12, these three elements 10, 11, 12 being firmly joined to each other, for example by gluing or by means of screws, the cover 12 comprising a handle 120 for transporting the appliance.

The pedestal 10 has an oblong outer shape and supports a heating unit 4, advantageously made of aluminum, disposed near a longitudinal end of the pedestal 10, the heating unit 4 enclosing a U-shaped resistor 40, conventionally powered by a circuit equipped with a thermostat, not shown in the figures. The pedestal 10 also supports a switch 5, actuated by a button 50, which makes it possible to cut off the electric power supply to the resistor 40.

The body 11, which is mounted on the pedestal 10 defines the lateral and bottom walls of a water tank 110 and includes an external clip 113 for securing the steam brush 3 when the appliance is stored.

The body 11 also includes a bell-shaped compartment 6 incorporated into the wall defining the bottom of the tank 110, the compartment 6 having a shape that is adapted so that its lower end comes to rest against a gasket 43 running around the heating unit 4. The compartment 6 thus defines a substantially closed boiling chamber 60 of limited volume, extending above the heating unit 4 and projecting into the middle of the water tank 110, the resistor 40 preferably extending horizontally at the bottom of the boiling chamber 60.

The boiling chamber 60 communicates with the water tank 110 via several supply lines 70 which, in parallel, supply the water for the boiling chamber 60, these channels 70 having a first end 70B opening into the tank 110 and a second end 70A opening into the boiling chamber 60, thus establishing a direct connection between the tank 110 and the boiling chamber 60, this connection allowing the gradual transfer, by gravity, of the water from the tank 110 to the boiling chamber 60.

Figure 4:
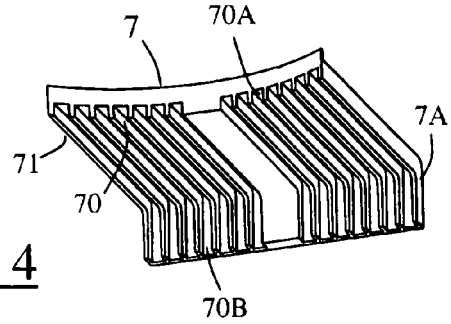
FIG. 4 is a perspective view of the part defining the supply lines of the boiling chamber of the appliance of FIG. 1.
Figure 5:
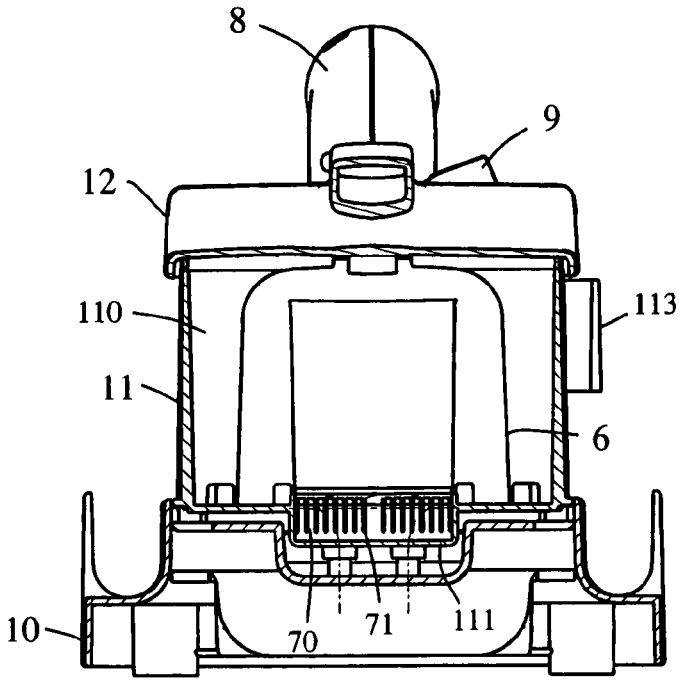
FIG. 5 is a cross-sectional view along line V-V of FIG. 3.

These supply lines 70 are advantageously defined by an insert 7, shown by itself in FIG. 4, comprising a series of ribs 71, parallel to each other, the insert 7 being fitted into an adapted seat in the bottom of the tank 110, placed upstream from an opening 61 formed at the pedestal of the compartment 6.

The supply lines 70 advantageously extend along a length of more than 30 mm, and preferably along a length on the order of 50 mm.

For example, the insert 7 defines fourteen supply lines 70 with an average length on the order of 50 mm, each supply line 70 having a square cross-section of 2.5 mm per side, the small flow cross-section of the supply lines 70, on the order of 6 $mm^2$, having the advantage of limiting the entry of steam bubbles into the supply lines 70.

The length of the supply lines 70, along with their small cross-section, makes it possible to adjust the head losses of the supply lines 70 so as to limit the phenomenon of hot water returning to the tank 110 when the heating unit 4 is in operation as a result of, among other things, the slight excess pressure generated by the heating process inside the boiling chamber 60.

Conversely, the increased number of supply lines 70 makes it possible to maintain a sufficient flow cross-section to obtain the desired flow of water between the tank 110 and the boiling chamber 60, in order to compensate for the gradual vaporization of the water in the boiling chamber 60.

This prevents the appearance of gaps in the steam, which can appear when the boiling chamber 60 is not sufficiently supplied with water due to the counterflow circulation of the hot water to the tank 110 or to the presence of steam bubbles in the supply circuit.

Preferably, the insert 7 comprises a bent part 7A such that the end 70B of the channels opens into a recess 111 of the tank 110 and is lower than the end 70A opening into the boiling chamber 60, the difference in height between the two ends 70A, 70B of the channels advantageously being greater than 5 mm and preferably on the order of 8 mm Such a feature, via a convection phenomenon linked to the existing thermal gradient between the cold water present in the tank 110 and the hot water in the boiling chamber 60, contributes to limiting the return of the hot water to the tank 110, the hot water having a tendency to remain in the upper part of the supply lines 70.

Advantageously, the heating unit 4 comprises a crown 41 extending vertically above the resistor 40, to a height on the order of 8 mm, so as to increase the surface area allowing a heat exchange with the water present in the boiling chamber 60.

The crown 41 has an open end that allows the free circulation of water between the inside and the outside of the crown 41, and the heating unit includes a wall 42 extending vertically in front of this open end, at a distance on the order of 5 mm from the end 70A of the supply line 70 of the boiling chamber 60, the wall 42 forming a barrier which limits the emission of steam bubbles toward the supply lines 70.

More particularly according to the invention, the top of the compartment 6 has a steam outlet 62 that is directly connected, by means of a connector 8, to the supply hose 2 of the steam brush 3 so that the steam produced by the boiling chamber 60 is sent to the hose 2 without being diffused into the tank 110.

The cover 12 that closes the tank 110 comprises, at the opposite end from the outlet for the hose 2, a cavity 121 equipped with a filling inlet 121A that opens directly into the tank 110, the tank 110 advantageously including a float, not shown in the figures, which slides inside a column 112 disposed underneath the filling inlet 121A so as to seal it when the level in the tank 110 is at its maximum.

Such a tank 110 can thus be filled at any time, even while the appliance is in operation, by pouring water through the filling inlet 121A; the latter does not need to be closed with a cap given the absence of steam inside the tank 110.

Moreover, the fact that the steam is not diffused through the tank 110 makes it possible to prevent the steam produced in the boiling chamber 60 from cooling in contact with the water prior to being diffused toward the hose 2. This makes it possible to limit the risk of condensates forming inside the hose 2, these condensates having the disadvantage of forming droplets that can be projected by the flow of steam through the steam brush 3, which has the disadvantage of wetting the fabric and runs the risk of burning the user.

In order to further reduce the risk of condensates forming inside the hose 2, the latter is preferably made from EPDM (Ethylene Propylene Diene Monomer) material in order to obtain good thermal insulation, thus limiting the cooling of the steam during its passage through the hose 2, the latter preferably having a length of more than 1.50 m in order to permit a more ergonomic use. The good thermal insulation provided by the EPDM material also has the advantage of reducing the surface temperature of the hose 2 when the appliance is in operation, and hence the risk of burns through contact with the hose 2.

Figure 6:
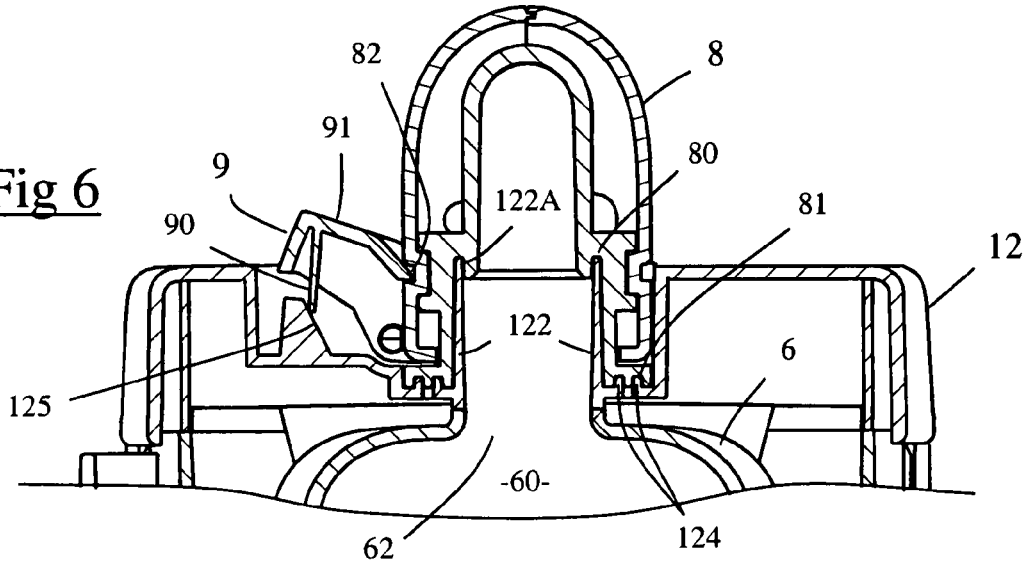
FIG. 6 is an enlarged cross-sectional view along line VI-VI of FIG. 3.
Figure 7:
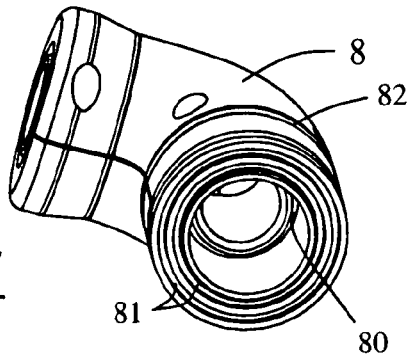
FIG. 7 is a perspective view of the connector, shown by itself.

In accordance with FIG. 6, the cover 12 includes a connecting tube 122 that surrounds the steam outlet 62, the connecting tube 122 projecting outside the cover 12 in the middle of a circular housing, or socket, 123 adapted for receiving the connector 8 disposed at the end of the hose 2, the connector 8 comprising a body of circular cross-section that allows it to rotate by 360° inside the housing 123.

In order to facilitate the rotation of the connector 8 in its housing, the latter is preferably sealed, not using a gasket but a series of baffles.

To this end, the connector 8 comprises a central bore into which the connecting tube 122 borne by the cover 12 fits, the end of the connecting tube 122 forming a rib 122A that is inserted into a groove 80 provided in a shoulder inside the central bore of the connector 8, this groove 80 cooperating with the end of the connecting tube 122 to form a first sealing barrier.

The seal of the connector 8 is also reinforced by the presence of two circular ribs 124 formed in the bottom of the housing 123, which are fitted into two circular grooves 81 provided in the bottom surface of the connector 8, the grooves 81 having a width greater, on the order of 0.5 mm, than the width of the ribs 124.

This produces a series of baffles, which surprisingly provides a very good seal for the steam connection, particularly owing to the formation of condensates, which fill in the space between the ribs 124 and the grooves 81.

The connector 8 is preferably removably mounted in the housing 123, the body of the connector 8 comprising a groove 82 on its outer surface, into which is fitted the end of a latch 9 pivotably mounted on the rim of the housing 123. The latch 9 is brought into a latched position by an elastic wall 90 borne by the latch 9 that comes to rest against an oblique wall 125 borne by the cover 12 so as to form return means.

Such a latch 9 can be brought into an unlatched position simply by pressing on the upper surface 91 of the latch 9 so as to disengage the end of the latch 9 from the groove 82 of the connector, after which the latter can be decoupled from the tube 122 by being lifted out of the housing 123.

A steam wrinkle-removing appliance of this type therefore has the advantage of making it possible to obtain steam very quickly once the appliance is turned on, thanks to the presence of the boiling chamber that makes it possible to heat only a volume of water that is reduced relative to the volume of the tank. Moreover, such an appliance has the advantage of allowing a continuous production of steam, the risk of gaps in the steam being considerably reduced due to the fact that the boiling chamber is supplied by numerous supply lines.

Lastly, such a wrinkle-removing appliance, in which the steam leaving the boiling chamber is sent directly into the supply hose of the steam brush without being diffused into the tank, has the advantage of making it possible to introduce high-temperature steam into the hose, thus limiting the risk of condensate formation, and makes it possible to obtain a steam-free tank enclosure that can be filled by the user at any time.

It is understood that the invention is in no way limited to the embodiment described and illustrated, which has been given only as an example. Modifications are possible, particularly with regard to the structure of the various elements or the substitution of technical equivalents, without going outside the scope of protection of the invention.

The invention claimed is:

1. Steam wrinkle-removing appliance comprising a water tank (110) in direct communication with a steam-producing boiling chamber (60), said boiling chamber (60) comprising a heating unit (4) and a steam outlet (62) through which the steam can freely flow toward a wrinkle-removing steam brush, characterized in that the boiling chamber (60) is supplied with water from the tank (110) by means of several supply lines (70) with a small flow cross-section of less than 15 $mm^2$, said supply lines extending lengthwise between an end (70B) opening into the tank (110) and an end (70A) opening into the boiling chamber (60) so as to generate head losses that limit the backflow of hot water or steam toward the tank (110).

2. Wrinkle-removing appliance according to claim 1, characterized in that it includes at least four supply lines (70) disposed in parallel.

3. Wrinkle-removing appliance according to claim 1, characterized in that said supply lines (70) extend along a length of more than 30 mm.

4. Wrinkle-removing appliance according to claim 1, characterized in that the end (70B) of the supply lines (70) opening into the tank (110) is at a lower level than the end (70A) opening into the boiling chamber (60).

5. Wrinkle-removing appliance according to claim 4, characterized in that said supply lines (70) have a part extending horizontally in the bottom of the tank (110) and a bent part opening into a recess (111) in the bottom of the tank (110).

6. Wrinkle-removing appliance according to claim 1, characterized in that said supply lines (70) are defined by an insert (7) in the bottom of the tank (110).

7. Wrinkle-removing appliance according to claim 1, characterized in that a wall (42) extends in the boiling chamber (60) in front of and in proximity to the end (70A) of the supply lines (70) so as to form a barrier that limits the backflow of water or steam toward the tank (110).

8. Wrinkle-removing appliance according to claim 1, characterized in that the heating unit (4) includes a heating resistor (40) extending horizontally in the bottom of the boiling chamber (60).

9. Wrinkle-removing appliance according to claim 8, characterized in that the heating resistor (40) is in a thermally conductive relationship with a crown (41) extending vertically inside the boiling chamber (60).

10. Wrinkle-removing appliance according to claim 8, characterized in that the steam outlet (62) of the boiling chamber (60) is in communication with a hose (2) connected to the steam brush so that the steam produced by the boiling chamber (60) is not diffused into the tank (110).

11. Wrinkle-removing appliance according to claim 10, characterized in that said hose (2) is made of EPDM material.

12. Wrinkle-removing appliance according to claim 1, characterized in that the boiling chamber (60) has a volume that is limited relative to the volume of the tank (110).

13. Wrinkle-removing appliance according to claim 12, characterized in that said boiling chamber (60) is incorporated into the tank (110).

14. Wrinkle-removing appliance according to claim 13, wherein the communication between the water tank and the steam chamber causes water to be transferred by gravity from the water tank to the steam chamber.

15. Wrinkle-removing appliance according to claim 1, further comprising the steam brush and a hose (2) for connecting said steam outlet (62) to said steam brush.

16. Steam wrinkle-removing appliance comprising a water tank (110) in direct communication with a steam-producing boiling chamber (60), said boiling chamber (60) comprising a heating unit (4) and a steam outlet (62) through which the steam can freely flow toward a wrinkle-removing steam brush, wherein said appliance further comprises a plurality of supply lines (70) directly connected between the tank (110) and the boiling chamber (60) to supply water from the tank (110) to the boiling chamber, each of said supply lines having a small flow cross-section of less than 15 $mm^2$, said supply lines extending lengthwise between an end (70B) opening into the tank (110) and an end (70A) opening into the boiling chamber (60) so as to generate head losses that limit the backflow of hot water or steam toward the tank (110).

17. Wrinkle-removing appliance according to claim 16, further comprising the steam brush and a hose (2) for connecting said steam outlet (62) to said steam brush.

18. Wrinkle-removing appliance according to claim 16, wherein the communication between the water tank and the steam chamber causes water to be transferred by gravity from the water tank to the steam chamber.

* * * * *